US005387496A

United States Patent [19]

DeBoer

[11] Patent Number: 5,387,496

[45] Date of Patent: Feb. 7, 1995

[54] INTERLAYER FOR LASER ABLATIVE IMAGING

[75] Inventor: Charles D. DeBoer, Rochester, N.Y.

[73] Assignee: Eastman Kodak Company, Rochester, N.Y.

[21] Appl. No.: 99,972

[22] Filed: Jul. 30, 1993

[51] Int. Cl.[6] ..... G03C 5/16; G03C 7/26

[52] U.S. Cl. ..... 430/322; 430/201; 430/271; 430/334; 430/944; 430/945; 430/464; 346/76 L; 503/227; 347/264

[58] Field of Search ..... 430/201, 270, 271, 944, 430/945, 964, 269, 334, 332; 503/227; 346/76 L

[56] References Cited

U.S. PATENT DOCUMENTS 4,973,572 11/1990 DeBoer ..... 503/227

5,171,650 12/1992 Ellis et al. ..... 430/20

*Primary Examiner*—Richard L. Schilling

*Attorney, Agent, or Firm*—Harold E. Cole

[57] ABSTRACT

A process of forming a single color, dye ablation image having an improved D-min comprising imagewise heating by means of a laser, a dye-ablative recording element comprising a support having thereon a dye layer comprising an image dye dispersed in a polymeric binder and an infrared-absorbing material, the laser exposure taking place through the dye side of the element, and removing the ablated image dye material to obtain an image in the dye-ablative recording element, and wherein the element contains an interlayer containing infrared-absorbing material and which is located between the support and the dye layer.

7 Claims, No Drawings

INTERLAYER FOR LASER ABLATIVE IMAGING

This invention relates to the use of an interlayer in a laser dye-ablative recording element.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

In one ablative mode of imaging by the action of a laser beam, an element with a dye layer composition comprising an image dye, an infrared-absorbing material, and a binder coated onto a substrate is imaged from the dye side. The energy provided by the laser drives off the image dye at the spot where the laser beam hits the element and leaves the binder behind. In ablative imaging, the laser radiation causes rapid local changes in the imaging layer thereby causing the material to be ejected from the layer. This is distinguishable from other material transfer techniques in that some sort of chemical change (e.g., bond-breaking), rather than a completely physical change (e.g., melting, evaporation or sublimation), causes an almost complete transfer of the image dye rather than a partial transfer. The transmission D-min density value serves as a measure of the completeness of image dye removal by the laser.

U.S. Pat. No. 4,973,572 relates to infrared-absorbing cyanine dyes used in laser-induced thermal dye transfer elements. In Example 3 of that patent, a positive image is obtained in the dye element by using an air stream to remove sublimed dye. However, there is no disclosure of the use of an interlayer containing infrared-absorbing material in the element in this process.

U.S. Pat. No. 5,171,650 relates to an ablation-transfer image recording process. In that process, an element is employed which contains a dynamic release layer which absorbs imaging radiation which in turn is overcoated with an ablative carrier topcoat. An image is transferred to a receiver in contiguous registration therewith. The useful image obtained in this process is contained on the receiver element. However, there is no disclosure in that patent that a useful positive image can be obtained in the recording element or of a single-sheet process.

It is an object of this invention to provide a process for improving the D-min obtained in a dye-ablative recording element. It is another object of this invention to provide a single-sheet process which does not require a separate receiving element.

These and other objects are achieved in accordance with the invention which comprises a process of forming a single color, dye ablation image having an improved D-min comprising imagewise heating by means of a laser, a dye-ablative recording element comprising a support having thereon a dye layer comprising an image dye dispersed in a polymeric binder and an infrared-absorbing material, the laser exposure taking place through the dye side of the element, and removing the ablated image dye material to obtain an image in the dye-ablative recording element, and wherein the element contains an interlayer containing infrared-absorbing material and which is located between the support and the dye layer.

It has been found unexpectedly that use of an interlayer containing infrared-absorbing material in the above dye-ablative recording element for laser ablative imaging significantly affects the desired dye cleanout as evidenced by the resulting faster writing speeds to achieve a given minimum density. Minimum densities of less than 0.10 are achieved in accordance with the invention.

The interlayer of the dye-ablative recording element employed in the process of this invention can be coated with or without a binder. If a binder is employed, it is preferably a hydrophilic material such as, for example, gelatin, poly(vinyl alcohol), hydroxyethyl cellulose, poly(vinyl pyrrolidone), casein, albumin, guargum, and the like. In a preferred embodiment of the invention, the hydrophilic binder is poly(vinyl alcohol) or nitrocellulose. When the hydrophilic binder is present, good results have been obtained at a concentration of from about 0.01 to about 1.0 $g/m^2$.

The dye ablation process of this invention can be used to obtain medical images, reprographic masks, printing masks, etc. The image obtained can be a positive or a negative image.

Any polymeric material may be used as the binder in the recording element employed in the process of the invention. For example, there may be used cellulosic derivatives, e.g., cellulose nitrate, cellulose acetate hydrogen phthalate, cellulose acetate, cellulose acetate propionate, cellulose acetate butyrate, cellulose triacetate, a hydroxypropyl cellulose ether, an ethyl cellulose ether, etc., polycarbonates; polyurethanes; polyesters; poly(vinyl acetate); polystyrene; poly(styrene-co-acrylonitrile); a polysulfone; a poly(phenylene oxide); a poly(ethylene oxide); a poly(vinyl alcohol-co-acetal)

such as poly (vinyl acetal), poly (vinyl alcohol-co-butyral) or poly(vinyl benzal); or mixtures or copolymers thereof. The binder may be used at a coverage of from about 0.1 to about 5 g/m$^2$.

In a preferred embodiment, the polymeric binder used in the recording element employed in the process of the invention has a polystyrene equivalent molecular weight of at least 100,000 as measured by size exclusion chromatography, as described in copending U.S. application Ser. No. 08/099,968 filed Jul. 30, 1993 by Kaszczuk and Topel and entitled, "HIGH MOLECULAR WEIGHT BINDERS FOR LASER ABLATIVE IMAGING".

In another preferred embodiment, the infrared-absorbing material employed in the recording element used in the invention is a dye which is employed in the image dye layer/and or in the interlayer. In still another preferred embodiment, the infrared-absorbing material is employed at a concentration of greater than about 0.1 g/m$^2$ whether in the dye layer or in the interlayer.

To obtain a laser-induced, dye-ablative image using the process of the invention, a diode laser is preferably employed since it offers substantial advantages in terms of its small size, low cost, stability, reliability, ruggedness, and ease of modulation. In practice, before any laser can be used to heat a dye-ablative recording element, the element must contain an infrared-absorbing material, such as cyanine infrared-absorbing dyes as described in U.S. Pat. No. 4,973,572, or other materials as described in the following U.S. Pat. Nos. 4,948,777, 4,950,640, 4,950,639, 4,948,776, 4,948,778, 4,942,141, 4,952,552, 5,036,040, and 4,912,083, the disclosures of which are hereby incorporated by reference. As noted above, the infrared-absorbing material is contained in either the image dye layer, the interlayer, or both. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat. As noted above, the laser exposure in the process of the invention takes place through the dye side of the dye ablative recording element, which enables this process to be a single-sheet process, i.e., a separate receiving element is not required.

Lasers which can be used in the invention are available commercially. There can be employed, for example, Laser Model SDL-2420-H2 from Spectra Diode Labs, or Laser Model SLD 304 V/W from Sony Corp.

Any dye can be used in the dye-ablative recording element employed in the invention provided it can be ablated by the action of the laser. Especially good results have been obtained with dyes such as anthraquinone dyes, e.g., Sumikaron Violet RS® (product of Sumitomo Chemical Co., Ltd.), Dianix Fast Violet 3RFS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumikaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumiacryl Blue 6G® (product of Sumitomo Chemical Co., Ltd.), and Aizen Malachite Green® (product of Hodogaya Chemical Co., Ltd.);

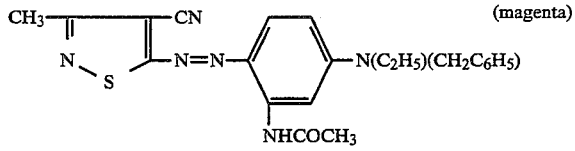
(magenta)

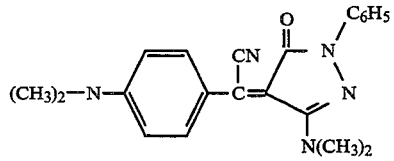
(magenta)

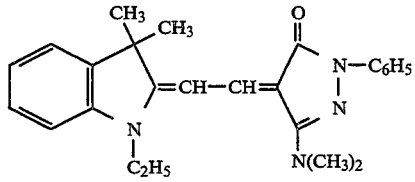
(yellow)

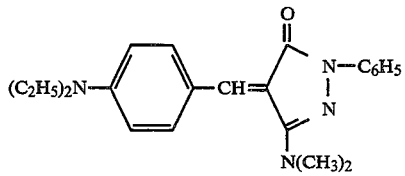
(yellow)

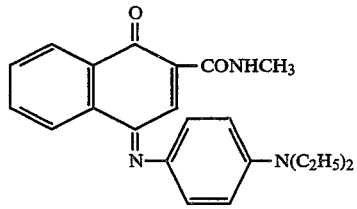
(cyan)

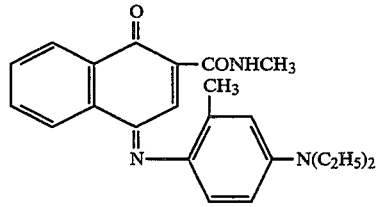
(cyan)

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 g/m$^2$and are preferably hydrophobic.

The dye layer of the dye-ablative recording element employed in the invention may be coated on the support or printed thereon by a printing technique such as a gravure process.

Any material can be used as the support for the dye-ablative recording element employed in the invention provided it is dimensionally stable and can withstand the heat of the laser. Such materials include polyesters such as poly(ethylene naphthalate; poly(ethylene terephthalate); polyamides; polycarbonates; cellulose esters such as cellulose acetate; fluorine polymers such as poly(vinylidene fluoride) or poly(tetrafluoroethylene-cohexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 μm. In a preferred embodiment, the support is transparent.

The following examples are provided to illustrate the invention.

EXAMPLE 1

To evaluate the effect on D-min of an interlayer containing an IR dye, samples were coated with the same dye combination containing an interlayer with and without an IR dye.

Element 1) A monocolor dye ablative recording element according to the invention was prepared by coating on a 100 μm thick poly(ethylene terephthalate) support the following layers:

a) a subbing layer of poly(acrylonitrile-covinylidene chloride-co-acrylic acid) (14:79:7 wt. ratio) (0.07 g/m$^2$);

b) an interlayer of poly(vinyl alcohol) Airvol 203®, (Air Products and Chemicals Inc.) coated at 0.22 g/m$^2$, triethanolamine (0.04 g/m$^2$) and IR-1 below (0.07 g/m$^2$) from water; and c) a neutral dye formulation containing 0.86 g/m$^2$ of 1000 sec. viscosity nitrocellulose (Hercules Inc.), 0.13 g/m$^2$ IR-2 below, 0.26 g/m$^2$ each of Cyan Dye D-1 and D-2 below, 0.07 g/m$^2$ each of Yellow Dye D-4 and D-5 below, and 0.09 g/m$^2$ each of Magenta Dye D-6 and D-7 below, from a 30:70 mixture of n-propanol and methyl isobutyl ketone.

Element 2) A control element was prepared similar to Element 1 except that the interlayer did not have any IR-1.

Element 3) This element was similar to Element 1 except that layer c) contained only Cyan Dye 2 at 0.62 g/m$^2$, Yellow Dye 4 at 0.15 g/m$^2$, and Magenta Dye 7 at 0.26 g/m$^2$ instead of the dye mixtures, and IR-2 was present at 0.17 g/m$^2$.

Element 4) A control element was prepared similar to Element 3 except that the interlayer did not have any IR-1.

Element 5) This element was similar to Element 1 except that layer c) contained 0.43 g/m$^2$ of 1000 sec. viscosity nitrocellulose (Hercules Inc.), 0.20 g/m$^2$ IR-2 below, 0.33 g/m$^2$ of Cyan Dye D-3 below, 0.85 g/m$^2$ of Cibaset Brown 2R® (Ciba-Geigy AG), and 0.86 g/m$^2$ of Magenta Dye D-7 below, from a 16:16:68 mixture of n-butyl acetate, n-butanol and methyl isoamyl ketone.

Element 6) A control element was prepared similar to Element 5 except that the interlayer did not have any IR-1.

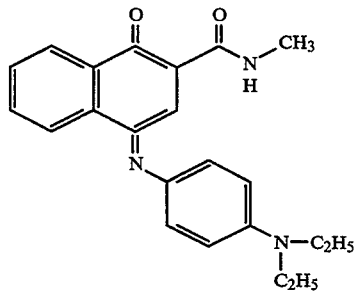
Cyan Dye D-1

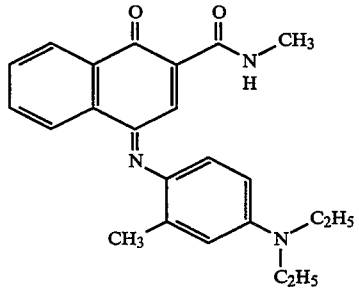
Cyan Dye D-2

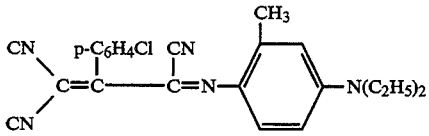
Cyan Dye D-3

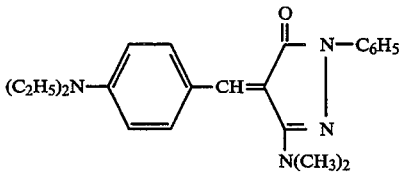
Yellow Dye D-4

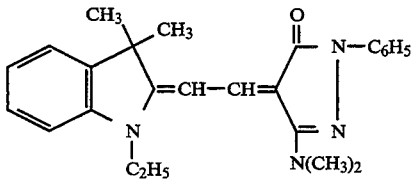
Yellow Dye D-5

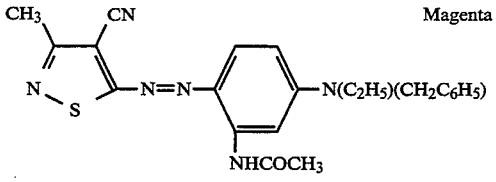
Magenta Dye D-6

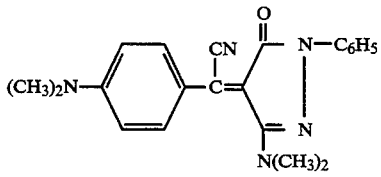
Magenta Dye D-7

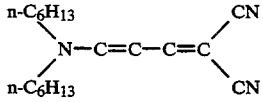
Liquid UV Dye

-continued

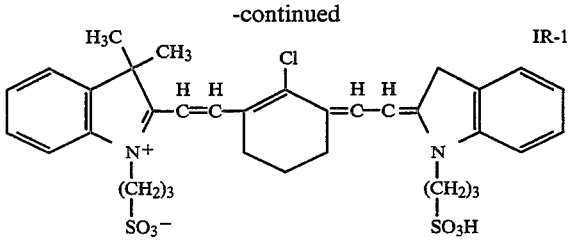

IR-1

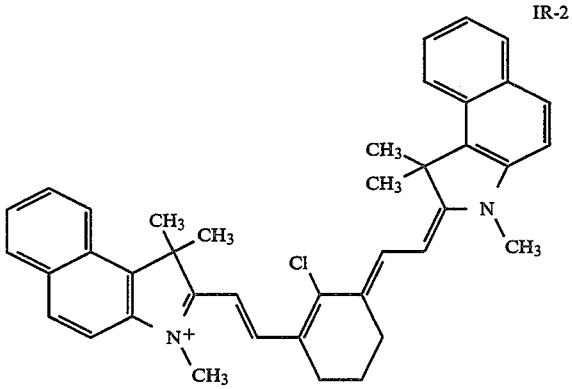

IR-2

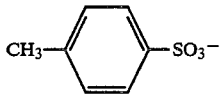

IR-2

The above elements were exposed in a laser thermal printer of the type disclosed in U.S. Pat. No. 5,268,708.

The diode lasers employed were Spectra Diode Labs No. SDL-2430, having an integral, attached optical fiber for the output of the laser beam with a wavelength range 800–830 nm and a nominal power output of 250 milliwatts at the end of the optical fiber. The cleaved face of the optical fiber (50 μm core diameter) was imaged onto the plane of the dye-ablative element with a 0.33 magnification lens assembly mounted on a translation stage giving a nominal spot size of 16 μm.

The drum, 53 cm in circumference, was rotated at varying speeds and the imaging electronics were activated to provide exposures at 827 mJ/cm$^2$. The translation stage was incrementally advanced across the dye-ablative element by means of a lead screw turned by a microstepping motor, to give a center-to-center line distance of 10 μm (945 lines per centimeter, or 2400 lines per inch). An air stream was blown over the donor surface to remove the sublimed dye. The measured average total power at the focal plane was 100 mW. The Status A density of the dye layer before imaging was approximately 3.0 and was compared to the residual density after writing a D-min patch at 200 rev./min.

The D-min values for the test pieces were then determined in an X-Rite densitometer Model 310 (X-Rite Co.) and recorded in Table 1 as follows.

TABLE 1

| Element | IR-1 in Interlayer (g/m$^2$) | D-min |
|---|---|---|
| 1 | yes | 0.02 |
| 2 (control) | none | 0.07 |
| 3 | yes | 0.03 |
| 4 (control) | none | 0.06 |
| 5 | yes | 0.03 |
| 6 (control) | none | 0.05 |

The above results show that the D-min values are consistently lower for all samples containing the water-soluble IR-1 dye in their interlayer, regardless of the number of image dyes present in the image dye layers of the samples tested.

EXAMPLE 2

This set of experiments was run to determine the effect of the levels of infrared-absorbing dyes in both imaging dye layer and interlayer as well as the effect on the presence of poly(vinyl alcohol) in the interlayer.

Twelve samples were coated as in Element 1 of Example 1, except that layer c) contained 0.71 g/m$^2$ Cyan dye D-3, 1.72 g/m$^2$ Cibaset Brown 2R® (Ciba-Geigy AG), 0.25 g/m$^2$ liquid UV dye shown above, 0.59 g/m$^2$ of 1139 sec. viscosity nitrocellulose (Hercules Inc.), and varying amounts of IR-2 as shown in Table 2 below, coated from a 4:1:1 mixture of methyl isoamyl ketone with butyl acetate and butanol; and layer b) contained 0.32 g/m$^2$ poly(vinyl alcohol) Elvanol 52-22® (DuPont Corp.), 0.03 g/m$^2$ triethanolamine, 0.003 g/m$^2$ nonylphenoxy polyglycidol, and varying amounts of IR-1 as shown below in Table 2 coated from water.

These coatings were exposed on an apparatus, similar to the one described in U.S. Ser. No. 799,471, at 15 Hz and 8 mm exposure. The Status A densities of the cleared out area were measured (D-min) using the X-Rite densitometer.

TABLE 2

| ELEMENT | IR-2 IN IMAGE DYE LAYER c) (g/m$^2$) | IR-1 IN INTERLAYER b) (g/m$^2$) | STATUS A D-MIN |
|---|---|---|---|
| 7 | 0.25 | 0.22 | 0.68 |
| 8 | 0.13 | 0.22 | 0.50 |
| 9 | None | 0.22 | 1.13 |
| 10 | 0.08 | 0.16 | 0.54 |
| 11 | 0.03 | 0.16 | 1.57 |
| 12 | 0.25 | 0.11 | 0.35 |
| 13 | 0.13 | 0.11 | 0.35 |
| 14 | None | 0.11 | 1.12 |
| 15 | 0.08 | 0.05 | 0.44 |
| 16* | 0.03 | 0.05 | 1.49 |
| 17 | 0.24 | None | 0.45 |
| 18 | 0.13 | None | 0.45 |

*Element 16 was the same as element 15, except that the liquid UV dye concentration in the image dye layer was cut in half.

The Status A Densities show that the best dye clean-out is obtained with a concentration of about 0.11 g/m$^2$ of water-soluble infrared-absorbing dye IR-1 in the interlayer, and more than 0.11 g/m$^2$ of solvent-coatable, infrared-absorbing dye IR-2 in the image dye layer.

EXAMPLE 3

This example was run to establish that no binder is needed for the water-soluble, infrared-absorbing dye in the interlayer.

Element 19) A monocolor dye ablative recording element according to the invention was prepared by coating on a 100 μm thick poly(ethylene terephthalate) support the following layers:

a) a subbing layer of poly(methylacrylate-co-vinylidene chloride-co-itaconic acid (0.11 g/m$^2$);

b) an interlayer of Type IV deionized gelatin (1.4 g/m$^2$) and nonylphenoxy polyglycidol (0.03 g/m$^2$); and c) Cyan dye D-3 (0.29 g/m$^2$), 0.83 g/m$^2$ Cibaset Brown 2R®(Ciba-Geigy AG), Magenta Dye D-7 (0.12 g/m$^2$) IR-2 (0.17 g/m$^2$) and 1000 sec. viscosity nitrocellulose (Hercules Inc.) (0.42 g/m$^2$) coated from a 12.5:12.5:75 n-butanol/isopropyl acetate/methyl isobutyl ketone mixture.

Element 20 was prepared similar to Element 19 except that the interlayer b) was 1.12 g/m$^2$ of IR-1.

These coatings were exposed on a laser thermal printer as described in U.S. Pat. No. 5,268,708, operating at different revolution speeds. The results of the D-min measurements are shown in Table 3.

TABLE 3

| | 150 RPM | 200 RPM | 250 RPM | 300 RPM | 400 RPM |
|---|---|---|---|---|---|
| ELEMENT 19 (no IR dye in interlayer) | 0.13 | 0.19 | 0.27 | 0.43 | 1.03 |
| ELEMENT 20 (IR in interlayer without binder) | 0.10 | 0.09 | 0.10 | 0.11 | 0.30 |

The above results show that the additional infrared-absorbing dye in a layer below the image dye layer is effective in contributing to improved dye cleanout as measured by the D-min value. The data also show that this improvement is obtained when the hydrophilic poly(vinyl alcohol) binder is omitted.

The invention has been described in detail with particular reference to preferred embodiments thereof, but it will be understood that variations and modifications can be effected within the spirit and scope of the invention.

What is claimed is:

1. A process of forming a single color, dye ablation image having an improved D-min comprising image-wise-heating by means of a laser, a dye-ablative recording element comprising a support having thereon a dye layer comprising an image dye dispersed in a polymeric binder and an infrared-absorbing material, said laser exposure taking place through the dye side of said element, and removing the ablated image dye material to obtain said image in said dye,ablative recording element, wherein said element also contains an interlayer containing poly(vinyl alcohol) and an infrared-absorbing material and which is located between said support and said dye layer.

2. The process of claim 1 wherein said interlayer is present at a concentration of from about 0.01 to about 1.0 g/m$^2$.

3. The process of claim 1 wherein said infrared-absorbing material in said dye layer is a dye.

4. The process of claim 3 wherein said infrared-absorbing dye is present at a concentration of greater than about 0.1 g/m$^2$.

5. The process of claim 1 wherein said infrared-absorbing material in said interlayer is a dye.

6. The process of claim 5 wherein said infrared-absorbing dye is present at a concentration of greater than about 0.1 g/m$^2$.

7. The process of claim 1 wherein said support is transparent.

* * * * *